United States Patent [19]

Kratky et al.

[11] 4,325,642

[45] Apr. 20, 1982

[54] STORAGE AND HOMOGENIZING TANK FOR KAOLIN SUSPENSIONS

[75] Inventors: Jiri Kratky; Ivan Fort, both of Prague; Petr Havel, Pilsen; Vaclav Machacek, Pilsen; Bohuslav Masek, Pilsen; Konstantin Hruban, Slapanice u Brna, all of Czechoslovakia

[73] Assignee: Vysoka skola chemicko-technologicka, Prague, Czechoslovakia

[21] Appl. No.: 184,025

[22] Filed: Sep. 4, 1980

[30] Foreign Application Priority Data

Sep. 11, 1979 [CS] Czechoslovakia ..... 6155-79

[51] Int. Cl.[3] ..... B01F 15/02; B01F 5/04

[52] U.S. Cl. ..... 366/137; 366/167; 366/279; 366/285

[58] Field of Search ..... 366/137, 167, 168, 172, 366/173, 279, 285

[56] References Cited

U.S. PATENT DOCUMENTS

| | | | |
|---|---|---|---|
| Re. 27,681 | 6/1973 | Gaddis | 366/172 |
| 1,397,767 | 11/1921 | Lochow | 366/168 |
| 1,587,840 | 6/1926 | Kilmer | 366/279 |
| 1,991,148 | 2/1935 | Gephart | 366/167 |
| 2,583,942 | 1/1952 | Lepin | 366/167 X |
| 2,608,392 | 8/1952 | Bowman | 366/137 |

*Primary Examiner*—Edward J. McCarthy

[57] ABSTRACT

Kaolin suspension homogenizing and storage tank provided with at least a single mixing device mounted on its side wall. The mixing device includes a propeller or paddle impeller with inclined blades, the diameter of which is 1/15 to 1/30 of the diameter of the tank and the velocity of the blade tips of the impeller range from 6 to 12 m/s. The arrangement includes an alternative circulation pump and at least a single jet.

6 Claims, 2 Drawing Figures

STORAGE AND HOMOGENIZING TANK FOR KAOLIN SUSPENSIONS

BACKGROUND OF THE INVENTION

The invention relates to a storage and homogenizing tank for kaolin suspensions solving the problem of homogenizing water-kaolin suspensions in large capacity tanks.

In the production of kaolin from the raw material it is necessary to employ a technological process which will achieve a preselected standard of quality for the final product.

Arrangements for treatment of kaolin use storage tanks which generally are in the shape of basins having an inclined bottom, and which are provided with low speed raking paddle impellers are already known. The final product obtained from these arrangements possess non-uniform properties. For instance, the content of ingredients, solid-phase concentration, whiteness and similar properties are non-uniform. Besides, it is impossible to store suitable kaolin suspensions interoperationally, since after a short time solid phase sedimentation takes place. This fact then interferes with further treatment.

SUMMARY OF THE INVENTION

It is a general object of this invention to provide a storage tank arrangement wherein the afore-described drawbacks are ameliorated or completely eliminated by using a novel kaolin-suspension homogenizing storage tank. The suspension obtained by the tank of the invention can be stored interoperationally and a final product of uniform quality can be obtained. The tank is provided with at least one agitating device having a propeller or pitched paddle impeller. The diameter of the impeller, i.e. the diameter of the type of impeller blades is 1/15 to 1/30 of the tank diameter and the blade tip velocity ranges from 6 to 12 m/s.

The arrangement can also be provided with a circulating pump and with at least one injection jet.

The storage and homogenizing tank according to this invention can be furthermore provided with a circulating pump and with at least one jet operating only in case the level of the content of the tank becomes so low that the agitating device is unable to perform its task. This jet is mounted close to the bottom of the tank and its axis makes an angle $\gamma$ from 3° to 30° with a horizontal plane.

The distance $H_2$ from the lower edge of the blade tip of this agitating device to the bottom of the vessel amounts of 0.1 to 3 diameters of the blade tips of the agitating device. The axis of the agitating device is disposed askew within a horizontal plane relative to a radius vector at an angle $\beta$ ranging from 1° to 20° to the left if the agitating device rotates in a clockwise direction when looking from the motor to the tank and is disposed askew of the same angle to the right if the agitating device rotates in a counter clockwise direction. If more agitating devices are required they are mounted along the circumference of the tank at angular distances $\alpha$ ranging from 15° to 60°.

The arrangement of the storage and homogenizing tank according to this invention provides suitable hydrodynamic conditions for the flow of the suspension, thereby safeguarding its perfect homogeneity. The arrangement of the invention makes, furthermore possible to interoperationally store the homogeneous suspension, a regulation and also an automation of the whole process. The result is the production of a product of required standard properties.

BRIEF DESCRIPTION OF THE DRAWING

Although such novel features are believed to be characteristic of the invention are pointed out in the claims, the invention may be further understood by reference to the description following and the accompanying drawings. All details not essential to the invention have been omitted.

DETAILED DESCRIPTION

Figure 1:
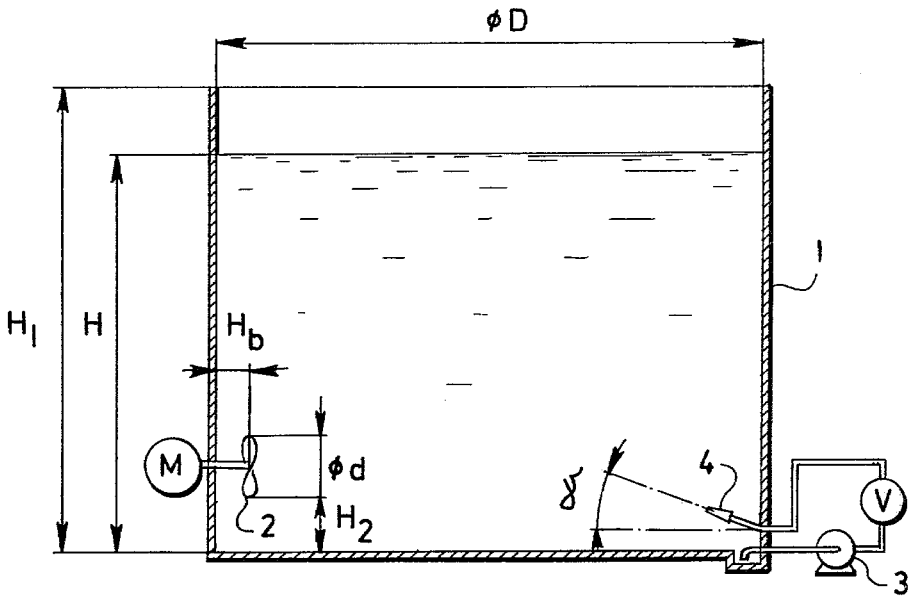
FIG. 1 is a schematic vertical projection of the arrangement of the invention.
Figure 2:
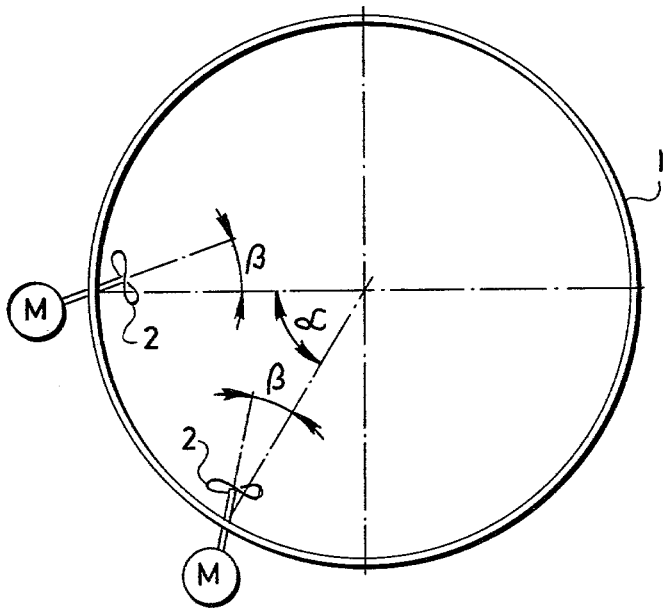
FIG. 2 is a schematic plan view of the storage tank.

The storage and homogenizing tank 1 is depicted as a cylindrical vertical vessel with a flat bottom having a diameter D and height $H_1$. The height H represents the level of the content of this vessel and amounts to 0.1 to 1.5 D. One or more laterally mounted agitating devices are arranged in the vessel, provided with an axial high speed mixer 2, for instance a propeller or pitched paddle impeller having a blade tip diameter d. The mixer 2 is mounted at a distance $H_2$ from the bottom of the tank 1 and at a distance $H_b$ from the wall of the tank 1 and its blade tip diameter is 1/15 to 1/30 of the diameter D of the tank 1, whereby its direction of rotation causes the liquid flow toward the wall opposite to the mixer 2. The frequency of rotation of the mixer 2 should be such that the circumferential speed of blade tips of the mixer 2 is within 6.0 to 12 m/s. The shaft of the mixer is mounted in a horizontal plane and is disposed askew with respect to a radius vector of the tank at an angle $\beta$ ranging from 1° to 20°. It is desirable to discharge the suspension even when the level of the charge of the tank drops below the level of the horizontal plane in which the mixer 2 is no more flooded in which case low discharge rates would occur so that sedimentation could take place. To eliminate this drawback the arrangement can be complemented by a circulating pump 3 having one or more jets 4, the axis of which are at an angle $\gamma$ with respect to a horizontal plane, the angle $\gamma$ being between 3° and 30°. This circulating pump can be started when the level of the suspension content of the tank drops to a level in which the agitating device is no more flooded and therefore unable to perform its task. Conventional control means of known design, not shown in the drawing, can be provided in the tank, indicating the level of the content of the tank 1 and controlling the operation of both the agitating device and the circulating pump.

The object of this invention can be utilized in connection with treatments of raw kaolin and for storage of kaolin suspensions for instance in paper, rubber and similar industries.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What we claim is:

1. An arrangement for homogenizing and storing a kaolin-suspension, comprising in combination;

a storage tank having a horizontal bottom and vertical side walls;

at least one agitating device mounted on said side walls, said agitating device comprising a rotatable shaft, driving means for rotating said shaft, and an impeller blade coaxially mounted on said shaft, said impeller blade having a diameter equalling 1/5 to 1/30 of the inside diameter of said storage tank; and the blade tip velocity of said impeller blade ranging from 6 to 12 m/s.

2. The arrangement for homogenizing and storing a kaolin-suspension as set forth in claim 1 including a circulating pump, conduit means connecting said pump to said storage tank, and at least one jet nozzle mounted in said storage tank adjacent to the bottom of the storage tank.

3. The arrangement for homogenizing and storing a kaolin-suspension as set forth in claim 1, wherein the minimum distance from the blade tip to the bottom of the tank is equal to 0.1 to 3 times the impeller blade diameter and the minimum distance from the blade tip to the vertical side walls of the vessel being 0.3 to 3 times the diameter of the impeller blade.

4. The arrangement for homogenizing and storing a kaolin-suspension as set forth in claim 1, the rotatable shaft being disposed parallel to the bottom of said storage tank and at an angle of 1° to 20° to the left with respect to a radial line passing through the shaft mount on the vertical side wall as viewed from the impeller shaft mount toward the center of the tank when the suspension is rotated clockwise and at an angle of 1° to 20° to the right as viewed from the impeller shaft towards the center of the tank when the suspension is rotated counterclockwise.

5. The arrangement for homogenizing and storing a kaolin-suspension as set forth in claim 1, wherein a plurality of agitating devices are mounted on the vertical side walls in a horizontal plane at an angular distance $\alpha$ from each other ranging from 15° to 60°.

6. The arrangement for homogenizing and storing a kaolin-suspension 2, wherein said nozzle is upwardly inclined with respect to the horizontal at angle $\gamma$ ranging from 3° to 30°.

* * * * *